US007631370B2

(12) United States Patent
Dunn et al.

(10) Patent No.: US 7,631,370 B2
(45) Date of Patent: Dec. 15, 2009

(54) TOILET TRAINING DEVICE FOR SMALL CHILDREN

(75) Inventors: Steven B. Dunn, Beverly Hills, CA (US); Mark Hatherill, Manhattan Beach, CA (US)

(73) Assignee: Munchkin, Inc., North Hills, CA (US)

( * ) Notice: Subject to any disclaimer, the term of this patent is extended or adjusted under 35 U.S.C. 154(b) by 364 days.

(21) Appl. No.: 11/267,622

(22) Filed: Nov. 4, 2005

(65) Prior Publication Data

US 2007/0101482 A1 May 10, 2007

(51) Int. Cl.
*A47K 13/00* (2006.01)

(52) U.S. Cl. ..... 4/239; 4/237

(58) Field of Classification Search ..... 4/237, 4/239, 246.1; 16/429, 114, 1
See application file for complete search history.

(56) References Cited

U.S. PATENT DOCUMENTS 1,652,304 A * 12/1927 Fischer ..... 4/235
3,722,903 A * 3/1973 Jones ..... 280/823
4,633,536 A 1/1987 Tribble-DuBose
4,638,514 A * 1/1987 Landsberger ..... 4/239
5,765,236 A 6/1998 Bethanis
5,781,939 A 7/1998 Bledsoe
5,862,898 A * 1/1999 Chang ..... 190/115
5,974,598 A * 11/1999 Granda-Cabrera ..... 4/483
5,978,976 A 11/1999 Chai
6,067,666 A 5/2000 Dixon
6,175,968 B1 * 1/2001 Schneider ..... 4/239
7,272,863 B2 * 9/2007 Pratt ..... 4/246.1
2004/0107486 A1 * 6/2004 Yoo ..... 4/246.1
2004/0199986 A1 10/2004 Bernsley

FOREIGN PATENT DOCUMENTS

WO WO 95/27430 10/1995

* cited by examiner

*Primary Examiner*—Gregory L Huson
*Assistant Examiner*—Karen Younkins
(74) *Attorney, Agent, or Firm*—Knoble Yoshida & Dunleavy, LLC

(57) ABSTRACT

A toilet training device for children that is placed over existing toilet seats has handles that extend into and out of the training device. The handles are individually adjustable and are capable of assisting a child in being able to have a secure grip on the training device. Additionally, stand members are provided that enable the training device to be stored in a convenient fashion.

12 Claims, 5 Drawing Sheets

TOILET TRAINING DEVICE FOR SMALL CHILDREN

BACKGROUND OF THE INVENTION

1. Field of the Invention

The invention relates to the field of children's educational devices. In particular the invention relates to toilet training seats for children.

2. Description of the Related Technology

One of the milestones that a child reaches when growing up is becoming potty trained. Part of the process of potty training is learning how to use adult bathroom facilities. In order to assist a child in the learning process a number of products have been developed to help encourage and assist a child in using adult toilet and other bathroom facilities.

Some commercial toilet training products have features that may be beneficial in helping a child adjust to the size and shape of a standard toilet. They can either be placed upon a toilet seat or act as a miniaturized version of a toilet. Although many of these products are effective to some extent in facilitating toilet training, they typically lack comfort and functionality that will enable a child to personalize the chair to his or her own size. Many toilet training devices take a one-size fits all approach to creating a toilet training seat. In addition, because toilets are generally sized for adults small children are frequently unable to rest their feet on the floor while they are sitting on the toilet or on a potty seat that is placed on the toilet. This creates a feeling of insecurity on the part of the child that may inhibit the toilet training process. Conventional toilet training devices uniformly fail to address this important issue.

Additionally, the toilet training products on the market typically fail to take into account the storability or the device. It is sometimes desirable to place the toilet training device in an area that does not interfere with daily traffic through a home or within the bathroom and so that the device does not take up unnecessary space when not in use.

Furthermore, conventional toilet training device designs typically are not conducive to optimum cleanliness and hygiene. For example, many of the devices on the market have unnecessary cracks and crevices that can easily become filled with substances such as dust, lint, feces, urine and other material and consequently begin to foster the growth of harmful bacteria and molds.

Therefore, there is a need for a toilet training device that accommodates the needs of an individual child, that maintains the ability to be easily stored, and prevents the unnecessary fostering of bacteria and molds.

SUMMARY OF THE INVENTION

Accordingly, it is an object of certain embodiments of the invention to provide a toilet training device that accommodates the needs of an individual child, accommodates the growth of a child, that maintains the ability to be easily stored, and prevents the unnecessary fostering of bacteria and molds.

According to a first aspect of the invention, a toilet training device includes a seat portion; an opening in the seat portion; a first handle; and first handle adjustment structure for permitting positional adjustment of the first handle relative to the seat portion.

According to a second aspect of the invention a toilet training device includes a seat portion; an opening in the seat portion; and stand structure for permitting the device to be stood in a substantially vertically erect upright position on a horizontal surface such as a floor.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figure 1:
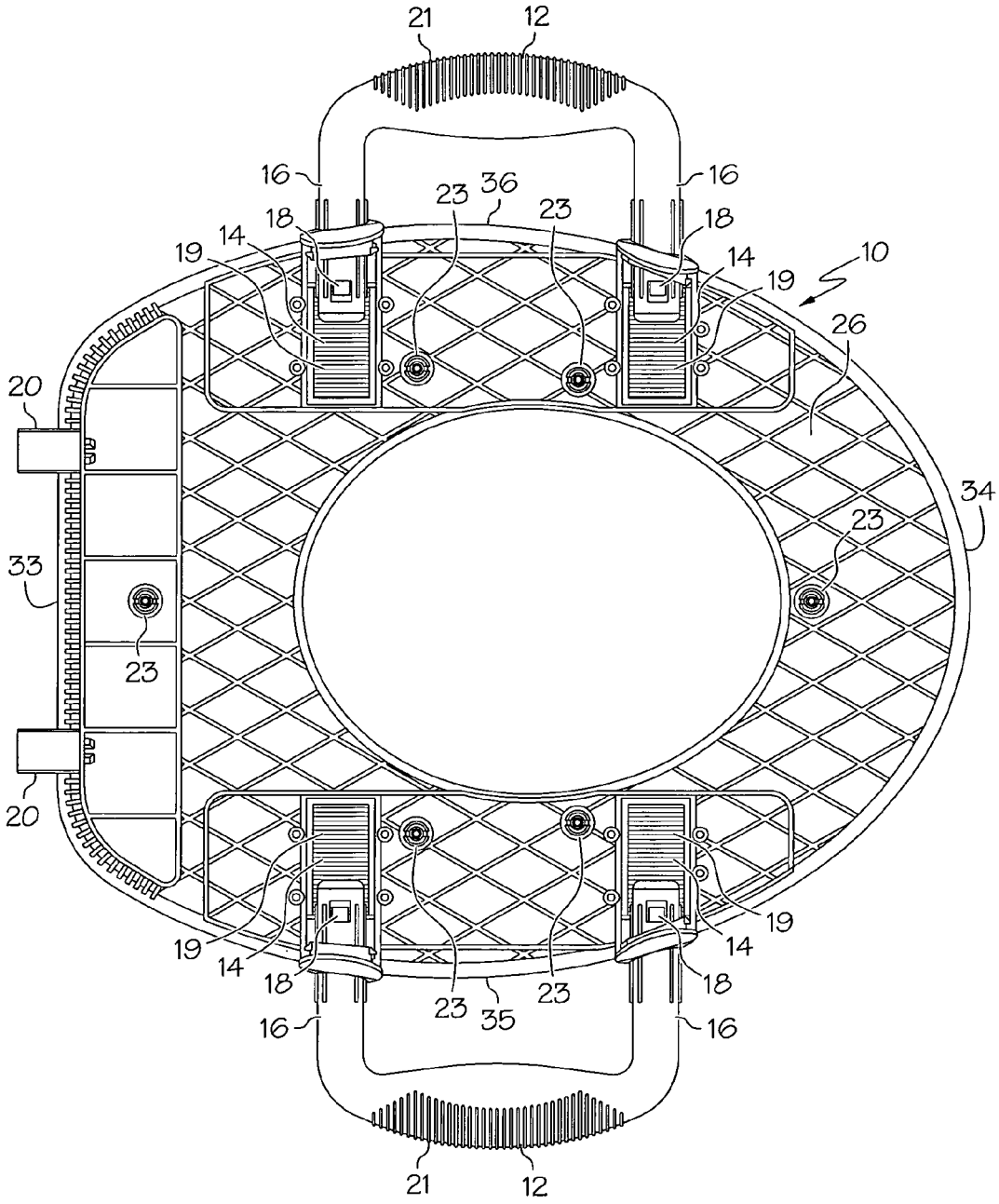
FIG. 1 shows a top down view of a toilet training device showing the seat portion without a cushion attached.
Figure 4:
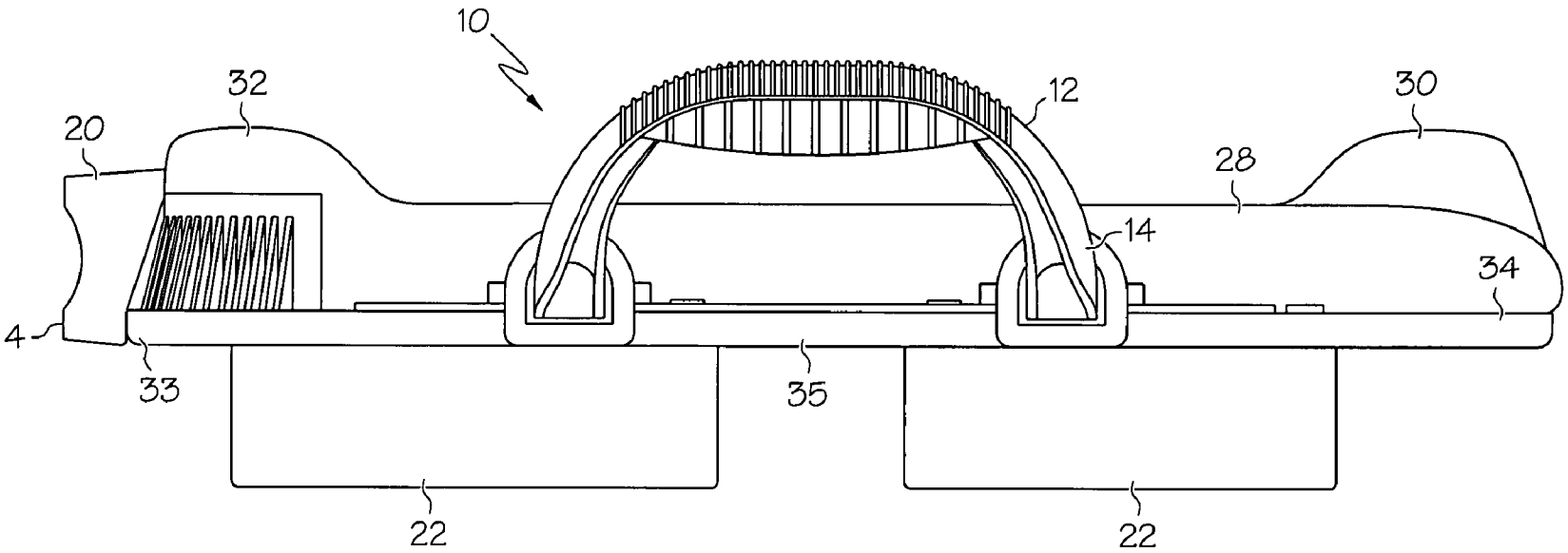
FIG. 4 shows a side view of the toilet training device with the cushion attached to the seat portion.

FIG. 1 shows a top view of toilet training device 10 showing seat portion 26 without a cushion 28, shown in FIG. 4, installed thereupon. Children will use toilet training device 10 in order to assist them in learning how to use bathroom facilities like an adult. Toilet training device 10 is designed to be placed over top of an existing toilet seat in order to permit a child to become familiar with and use an adult toilet.

Toilet training device 10 has first and second handles 12 that are respectively located on a first side 35 and a second side 36 of seat portion 26. The main purpose of the handles 12 is to provide the child being toilet trained a feeling of stability and security when sitting on the toilet training device 10 that will mitigate to some extent the feeling of insecurity that small children tend to feel because their feet do not touch the floor when sitting on a toilet.

Figure 5:
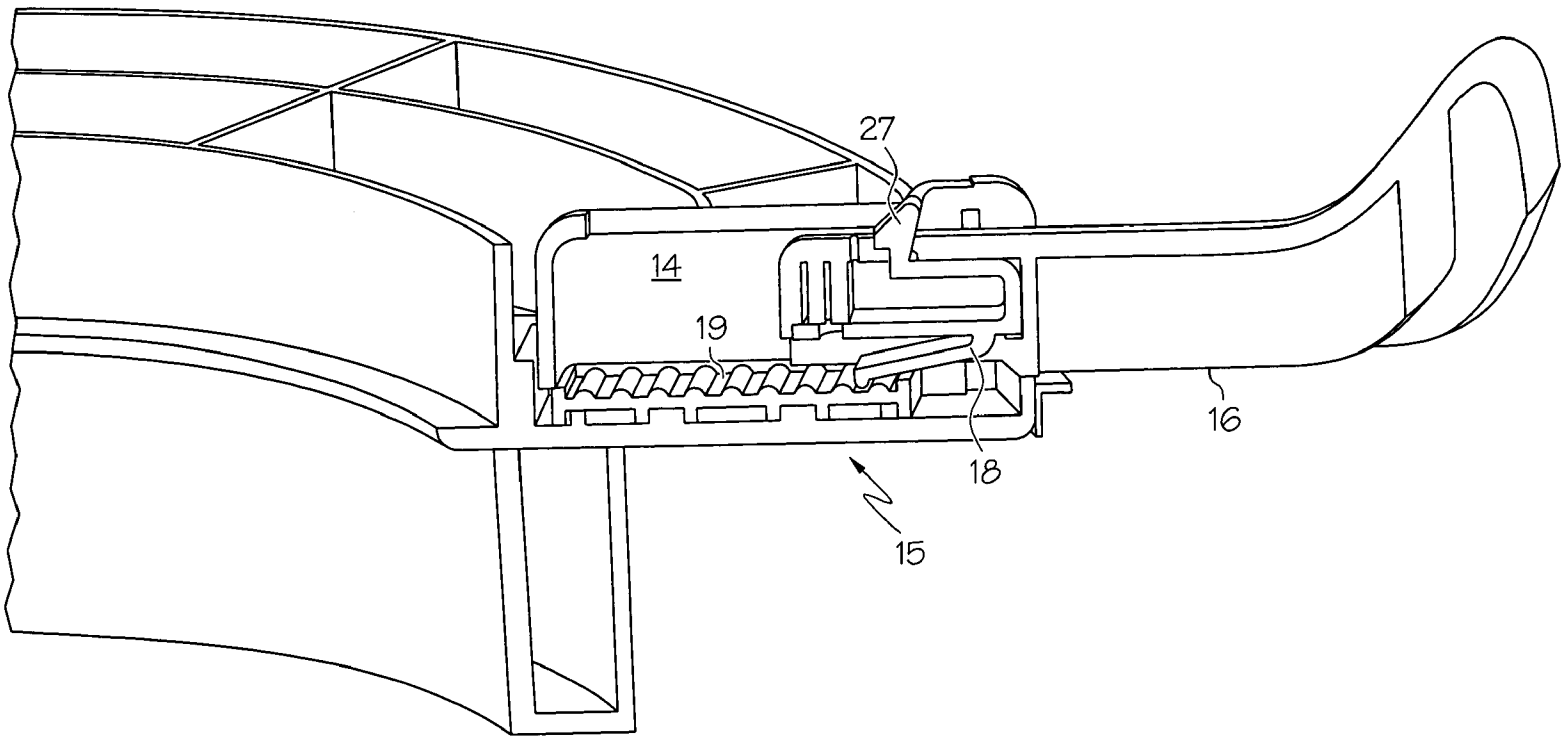
FIG. 5 is a fragmentary cross-sectional view depicting a handle adjustment mechanism.

Handles 12 are preferably located substantially symmetrically across seat portion 28 from each other. Handles 12 are each constructed and arranged to be insertable within and retractable out of complementary recesses or receptacles 14 that are defined in seat portion 28 by indexable adjustment systems 15. Handle 12 preferably has two arm portions 16 that are inserted into the arm receptacles 14. There are two arm receptacles 14 located on first side 35, and two receptacles 14 located on second side 36 of seat portion 26. As is best shown in FIG. 5, arm receptacles 14 are indexed with a plurality of ridges 19 that are defined along an insert that is located within the interior of the receptacle. Arm portions 16 have spring-loaded indexing members 18 that releasably interengage the ridges 19 to permit handle 12 to be indexed in one of a plurality of different positions relative to seat portion 26. These spring-loaded indexing members 18 further include a cam portion 27 that is constructed and arranged to engage an opposite, upper surface of the arm receptacle 14 in order to provide a constant downward bias to the portion of the indexing member 18 that releasably contacts the ridges 19 when the handle 12 is operatively inserted into the receptacle 14.

The movement of handle 12 is accomplished by applying pressure, or pushing handle 12 in a direction into seat portion 26 or by pulling handle 12 in a direction away from seat portion 26. Each handle 12 may be pushed into and pulled out of seat portion 26 separately and independently of the other handle. A gripping portion 21 located at a distal end of handle 12 facilitates pushing or pulling handle 12. When in use a child or caregiver will manipulate handles 12 to accommodate the child's preferred position. This enables a child to customize the toilet training device 10 to his or her own needs. Additionally, the ability to adjust handles 12 permits a child to be able to comfortably continue to use toilet training device 10 as he or she grows.

Seat portion 26 additionally has front portion 34 and rear portion 33. Located at rear portion 33 is a stand system including stand members 20 that are connected to seat portion 26. Stand members 20 are utilized in order to store toilet training device 10 in a vertical upright position either on the floor of a bathroom or upon some other horizontal surface. When stored vertically toilet training device 10 will only rest upon stand members 20. Vertically storing toilet training device 10 will permit the device to be stored in a space efficient manner, while still remaining readily accessible by a child or parent. In a preferred embodiment two stand members 20 are used to enable storage, however this number could be increased or decreased so long as the stand members 20 still prove effective in supporting device 10 in a stable manner.

Figure 3:
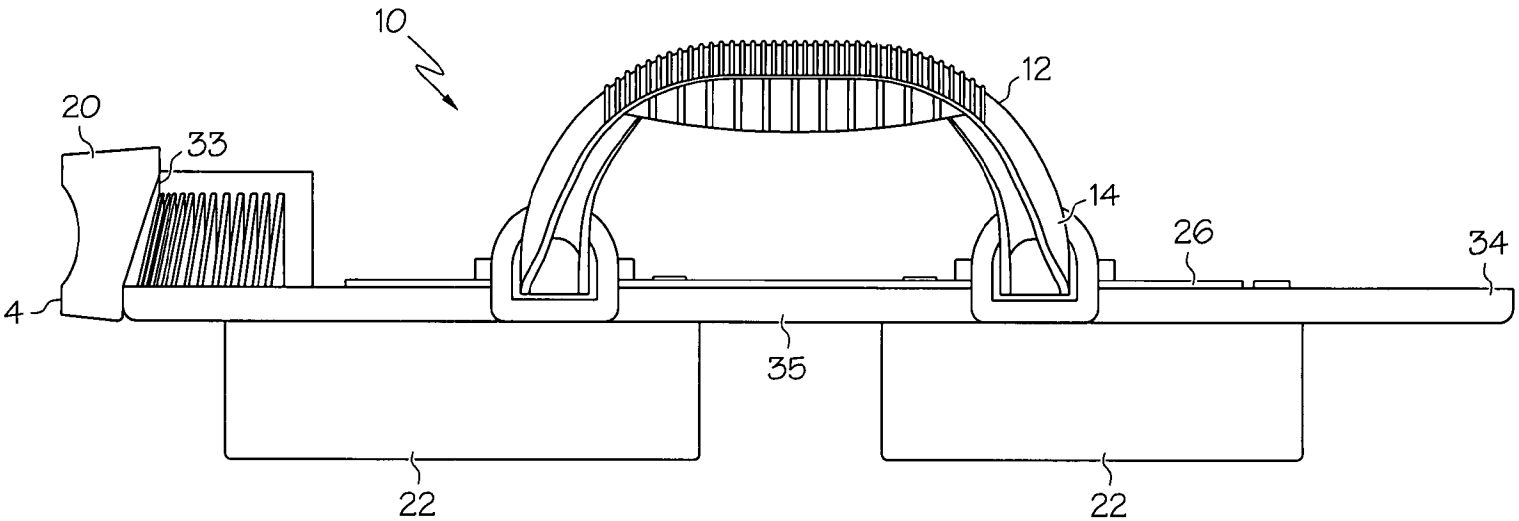
FIG. 3 shows a side view of the toilet training device without the cushion attached.

FIGS. 3 and 4 show stand members 20 as viewed from the side. In the preferred embodiment, stand members 20 each have a flat lower surface that is preferably dimensionally large enough to span a grouting crack in a conventional tiled floor. Preferably, each flat lower surface is at least 0.375 inches at its minimum span of width. In addition, at least one arched recess is preferably defined in each of the flat lower surfaces. The arched shape provides more stabilization for stand members 20 when the toilet training device 10 is stored on a surface that is not entirely level, or that may be textured in such a manner so as to prevent an entirely flat stand member from resting properly. For example, arched stand member 20 will have projected areas 24 sufficiently spaced apart (preferably a minimum of 0.375 inches) so as to avoid the grouted areas on a tiled bathroom floor. Stand members 20 are also sized in order to avoid interfering with the toilet seats when toilet training device 10 is in use. This is accomplished by having the length of stand member 20 not extend substantially longer than rear portion 33 when toilet training device 10 is placed upon the toilet seat.

Figure 2:
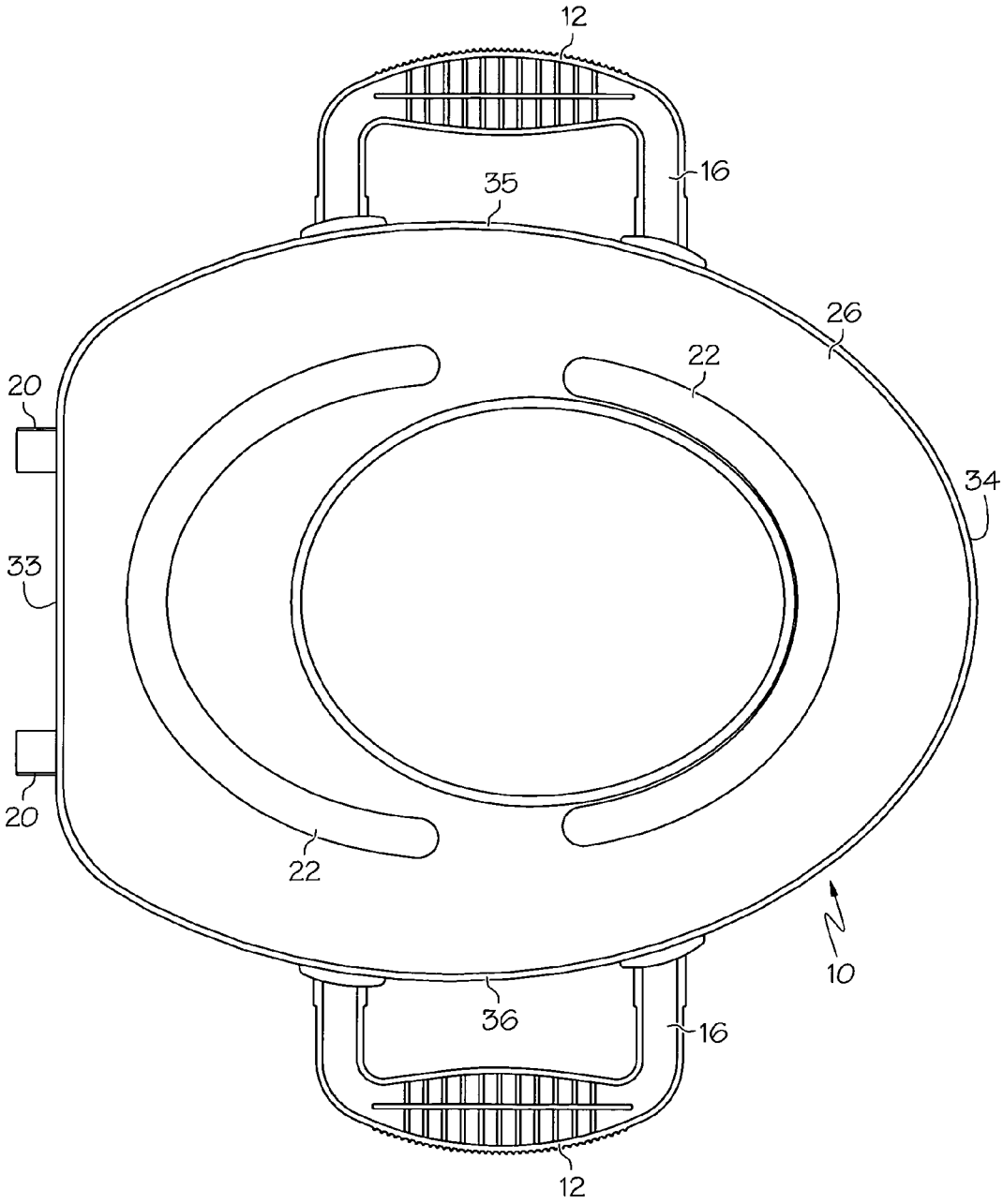
FIG. 2 shows a bottom view of toilet training device.

FIG. 1 also shows the tops of collapsing mushroom head connector elements 23 that are used to secure seat positioners 22 that are depicted in FIG. 2. Seat positioners 22 are secured through seat portion 26 and are then covered by cushion 28 when toilet training device 10 is fully assembled. This prevents the exposure of any unnecessary grooves or crevices due to screws. Preventing the exposure of cracks and crevices prevents the build up of bacteria, mildew and mold.

FIG. 2 shows a view of seat member 26 from below. The bottom of seat member 26 is made from a plastic material, such as polypropylene, an ABS copolymer or nylon so that a smooth surface is formed that further reduces the number of potential areas in which grime or bacteria can grow. As noted above, seat positioners 22 are attached to seat member 26. Seat positioners 22 are preferably semi-circular in shape and are located proximate the opening in seat member 26. As shown in FIG. 3, seat positioners 22 extend downwards. Seat positioners 22 are designed to fit within an opening of a conventional home toilet seat. The shape of seat positioners 22 can accommodate any variety of toilet seat openings and permit secure placement of the device. Usage of the two semi-circular shaped seat positioners 22 enables safe securing of the device while keeping the overall cost of a material used in the construction to a minimum. Seat positioner 22 may also be constructed to form one complete oval or circle, or alternatively, broken into smaller arcs.

FIG. 4 shows toilet training device 10 with the cushion 28 installed upon the seat portion 26. Cushion 28 is filled with foam material in order to provide a comfortable seat for children when using training device 10. Cushion 28 has a raised rear portion 32 for added comfort. In the front of cushion 28 there is a raised front portion 30 that acts as a urine guard. Cushion 28 is further shaped and designed to cover and conceal any exposed cracks and crevices that may be present in seat portion 26.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A toilet training device comprising:

a seat portion;

an opening in said seat portion;

a first handle and a second handle;

first handle adjustment means for permitting positional adjustment of said first handle relative to said seat portion by releasably pushing and pulling said first handle; wherein said first handle adjustment means comprises a first handle indexing means for permitting adjustment of said first handle in one of a plurality of predetermined discrete positions relative to said seat portion, wherein releasably pushing and pulling said first handle engages said first handle indexing means;

stand means for permitting said device to be stood in a substantially vertically erect upright position on a horizontal surface such as a floor, wherein said stand means comprises a first stand member that is attached to said seat portion, and, wherein said first stand member has a flat lower surface for bearing against a horizontal surface such as a floor, and wherein said flat lower surface is dimensionally large enough to span a grouting crack in a conventional tiled floor.

2. The toilet training device of claim 1, wherein said flat lower surface is at least 0.375 inches at its minimum width.

3. The toilet training device of claim 1, wherein said flat lower surface has a recess defined therein.

4. A toilet training device comprising:

a seat portion;

an opening in said seat portion;

stand means for positioning said device to be stood in a substantially vertically erect upright position on a horizontal surface such as a floor; and wherein said stand means comprises first and second stand members having a flat lower surface for bearing against a horizontal surface such as a floor, and wherein said flat lower surface is dimensionally large enough to span a typical grouted crack in a conventional tiled floor.

5. The toilet training device of claim 4, wherein said stand means comprises a first stand member that is attached to said seat portion.

6. The toilet training device of claim 4, wherein said flat lower surface is at least 0.375 inches at its minimum width.

7. The toilet training device of claim 4, wherein said flat lower surface has a recess defined therein.

8. The toilet training device of claim 4, wherein there are no exposed screws visible from the exterior of said toilet training device.

9. The toilet training device of claim 4, wherein said seat portion has a top side and a bottom side, and said bottom side has a raised semi-circular portion located proximate said opening for positioning said device on a toilet.

10. The toilet training device of claim 9, wherein said top side of said seat portion is cushioned.

11. The toilet training device of claim 4, wherein said stand means is constructed and arranged so as to permit said device to be fitted on a conventional toilet seat without interference from said stand means.

12. A toilet training device comprising:

a seat portion;

an opening in said seat portion;

a first handle;

first handle adjustment means for permitting positional adjustment of said first handle relative to said seat portion, further comprising stand means for permitting said device to be stood in a substantially vertically erect upright position on a horizontal surface such as a floor;

wherein said stand means comprises a first stand member that is attached to said seat portion; and wherein said first stand member has a flat lower surface for bearing against a horizontal surface such as a floor, and wherein said flat lower surface is dimensionally large enough to span a grouting crack in a conventional tiled floor.

* * * * *

UNITED STATES PATENT AND TRADEMARK OFFICE

CERTIFICATE OF CORRECTION

PATENT NO. : 7,631,370 B2
APPLICATION NO. : 11/267622
DATED : December 15, 2009
INVENTOR(S) : Dunn et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 469 days.

Signed and Sealed this

Second Day of November, 2010

David J. Kappos

David J. Kappos
*Director of the United States Patent and Trademark Office*